US008323485B2

(12) United States Patent
Blundell et al.

(10) Patent No.: US 8,323,485 B2
(45) Date of Patent: Dec. 4, 2012

(54) STORM WATER FILTER SYSTEMS

(75) Inventors: Peter Blundell, Vancouver, WA (US); Thomas C. Twitchell, Reno, NV (US)

(73) Assignee: Xeripave, Vancouver, WA (US)

( * ) Notice: Subject to any disclaimer, the term of this patent is extended or adjusted under 35 U.S.C. 154(b) by 0 days.

(21) Appl. No.: 13/271,097

(22) Filed: Oct. 11, 2011

(65) Prior Publication Data

US 2012/0097617 A1 Apr. 26, 2012

Related U.S. Application Data

(63) Continuation of application No. PCT/US2011/052648, filed on Sep. 21, 2011.

(60) Provisional application No. 61/455,608, filed on Oct. 25, 2010.

(51) Int. Cl.
*E03F 5/06* (2006.01)

(52) U.S. Cl. ..... 210/163; 210/164; 210/170.03

(58) Field of Classification Search ..... 210/747.3, 210/767, 131, 163, 164, 170.03; 404/2, 4, 404/5, 25

See application file for complete search history.

(56) References Cited

U.S. PATENT DOCUMENTS

| | | | | | |
|---|---|---|---|---|---|
| 928,481 | A | * | 7/1909 | Tenold | 210/131 |
| 4,376,595 | A | * | 3/1983 | Shaw | 404/4 |
| 4,935,129 | A | * | 6/1990 | Wang | 210/131 |
| 5,192,156 | A | | 3/1993 | Webb | |
| 5,284,580 | A | | 2/1994 | Shyh | |
| 5,375,940 | A | * | 12/1994 | Kobayashi | 404/2 |
| 5,405,539 | A | | 4/1995 | Schneider | |
| 5,575,925 | A | | 11/1996 | Logue, Jr. | |
| 5,632,889 | A | | 5/1997 | Tharp | |
| 5,643,445 | A | | 7/1997 | Billias et al. | |
| 5,650,065 | A | | 7/1997 | Sewell | |
| 5,788,849 | A | | 8/1998 | Hutter, Jr. et al. | |
| 5,989,417 | A | * | 11/1999 | Fleischhacker | 210/163 |
| 6,146,051 | A | * | 11/2000 | Pratt | 404/2 |
| 6,206,607 | B1 | * | 3/2001 | Medico et al. | 404/2 |
| 6,254,770 | B1 | * | 7/2001 | Remon | 210/163 |
| 6,270,663 | B1 | | 8/2001 | Happel | |
| 6,315,897 | B1 | | 11/2001 | Maxwell | |

(Continued)

FOREIGN PATENT DOCUMENTS

| | | | |
|---|---|---|---|
| JP | 5-17992 | * | 1/1993 |
| JP | 8-120761 | * | 5/1996 |

OTHER PUBLICATIONS

US Receiving Office, International Search Report regarding PCT Application No. PCT/US2011/052648, Feb. 7, 2012, 2 pages.

(Continued)

*Primary Examiner* — Christopher Upton
(74) *Attorney, Agent, or Firm* — Kolisch Hartwell, PC

(57) ABSTRACT

A filter system for a storm drain having an inlet is disclosed. The filter system may be configured to receive storm water having debris and to separate at least a portion of the debris from the storm water to produce filtered storm water. The filter system may include a pervious paver having a feed side and a permeate side, the pervious paver being configured to receive storm water on the feed side and to retain at least a portion of the debris on the feed side. The filtered storm water may be formed from the storm water that passes from the feed side to the permeate side. The filter system may additionally include a frame assembly configured to support the pervious paver adjacent to the inlet.

10 Claims, 10 Drawing Sheets

U.S. PATENT DOCUMENTS

| | | | | |
|---|---|---|---|---|
| 6,562,233 | B1 * | 5/2003 | Schilling et al. | 210/164 |
| 6,609,852 | B2 * | 8/2003 | Wimberger | 210/163 |
| 7,105,086 | B2 * | 9/2006 | Saliba | 210/163 |
| 7,112,274 | B1 | 9/2006 | Sanguinetti | |
| 7,128,831 | B2 * | 10/2006 | Newman | 210/163 |
| 7,927,037 | B2 | 4/2011 | Tonder et al. | |
| 7,959,799 | B2 | 6/2011 | Happel et al. | |
| 2007/0131597 | A1 * | 6/2007 | Chen | 210/164 |
| 2008/0058461 | A1 | 3/2008 | Cummins | |
| 2008/0180833 | A1 | 7/2008 | Ohinata | |
| 2011/0193267 | A1 | 8/2011 | Tonder et al. | |

OTHER PUBLICATIONS

US Receiving Office, Written Opinion of the International Searching Authority regarding PCT Application No. PCT/US2011/052648, Feb. 7, 2012, 10 pages.

* cited by examiner

STORM WATER FILTER SYSTEMS

CROSS-REFERENCE TO RELATED APPLICATIONS

This application is a continuation of International Application Number PCT/US11/52648 entitled "Storm Water Filter Systems," filed Sep. 21, 2011 and designating the United States, which claims priority to U.S. Provisional Patent Application Ser. No. 61/455,608 entitled "Water Filter and Pest Barrier Systems," filed Oct. 25, 2010. The complete disclosures of the above applications are hereby incorporated by reference for all purposes.

BACKGROUND OF THE DISCLOSURE

Storm water systems collect storm water, such as excess rain and/or ground water, from paved streets, parking lots, sidewalks, and/or roofs. Those systems may transport the storm water via extensive lengths of piping to discharge the storm water into, for example, rivers or streams. Storm water may, however, pick up debris and/or chemicals from the paved streets, parking lots, sidewalks, and/or roofs. Debris may include tree branches, paper or plastic containers, lawn clippings, leaves, paper or plastic wrappers, particles, etc. When the storm water systems are not collecting rain and/or ground water, those systems may have standing water, such as in sumps and/or catch basins. The standing water may provide breeding grounds and/or inhabitation for mosquitoes, rodents, and/or other pests.

Examples of storm water filter systems, are disclosed in U.S. Pat. Nos. 7,959,799; 7,112,274; 6,270,663; 5,788,849; 5,650,005; 5,643,445; 5,632,889; 5,575,925; 5,405,539; 5,284,580; and 5,192,156. The complete disclosures of the above patents are hereby incorporated by reference for all purposes.

SUMMARY OF THE DISCLOSURE

The present disclosure is directed to a filter system for a storm drain having an inlet. The filter system may be configured to receive storm water having debris and to separate at least a portion of the debris from the storm water to produce filtered storm water. The filter system may include a pervious paver having a feed side and a permeate side. The pervious paver may be configured to receive storm water on the feed side and to retain at least a portion of the debris on the feed side. The filtered storm water may be formed from the storm water that passes from the feed side to the permeate side. The filter system may additionally include a frame assembly configured to support the pervious paver adjacent to the inlet.

The present disclosure is also directed to a filter system for a storm drain having an inlet, a ledge that at least partially surrounds the inlet, and one or more side walls. The filter system may be configured to receive storm water having debris and to separate debris from the storm water to produce filtered storm water. The filter system may include a pervious paver having a feed side and a permeate side. The pervious paver may be configured to receive storm water on the feed side and to retain the debris on the feed side. The filtered storm water may be formed from the storm water that passes from the feed side to the permeate side. The pervious paver may include an aperture. The filter system may additionally include an overflow assembly. The overflow assembly may include an overflow pipe that extends through the aperture, a pipe support attached to the overflow pipe and supported on the pervious paver, and a valve assembly including a valve and a biasing mechanism. The valve may be configured to move between an open position in which the storm water is allowed to flow through the overflow pipe, and a closed position in which the storm water is prevented from flowing through the overflow pipe. The biasing mechanism may be configured to urge the valve toward the closed position. The valve may be configured to move, when the overflow pipe receives the storm water, toward the open position against urging of the biasing mechanism. The biasing mechanism may be configured to maintain the valve in the closed position when a pest attempts to move through the overflow pipe. The filter system may further include a frame assembly configured to support the pervious paver adjacent to the inlet. The frame assembly may be configured to be attached to the one or more side walls adjacent to, but spaced from, the inlet without the frame assembly contacting the ledge.

The present disclosure is also directed to a method of filtering storm water received in a storm drain via a pervious paver having a feed side and a permeate side. The storm water may have debris. The method may include directing the storm water on to the feed side of the pervious paver. The method may additionally include filtering the storm water via the pervious paver such that at least a portion of the debris is retained on the feed side of the pervious paver.

DETAILED DESCRIPTION OF THE DISCLOSURE

Figure 1:
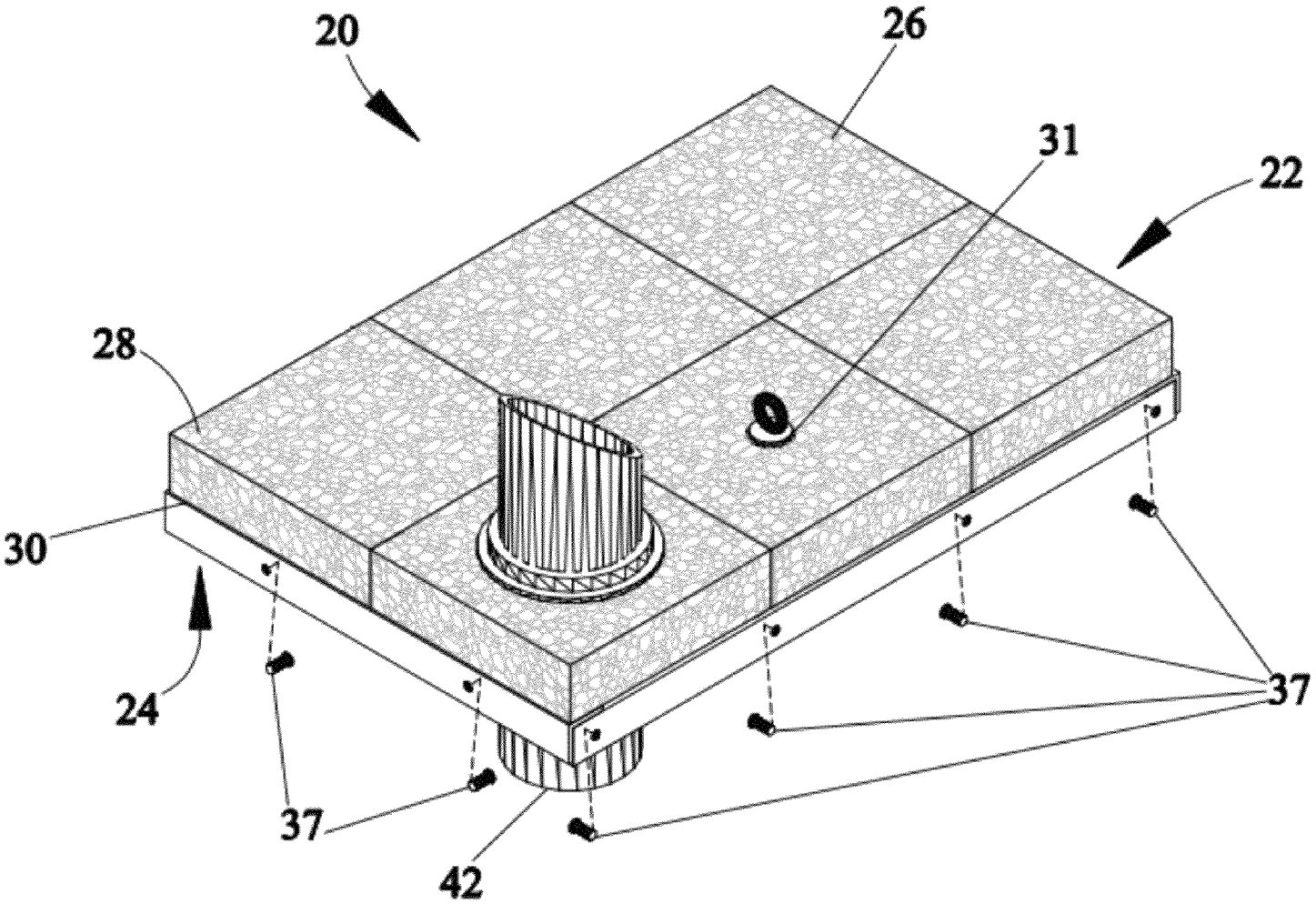
FIG. 1 is an isometric view of an example of a storm water filter system.

FIG. 1 shows an example of a storm water filter system 20. The storm water filter system may include any suitable structure configured to receive storm water having debris and to separate at least a portion of the debris from the storm water to produce filtered storm water. For example the storm water filter system may include a filter assembly 22 and a frame assembly 24, as shown in FIG. 1.

The filter assembly may include any suitable structure configured to separate at least a portion (or at least a substantial portion) of the debris from the storm water to produce filtered storm water. For example, filter assembly 22 may include one or more pervious pavers 26. The pervious pavers may include a feed side 28 and a permeate side 30, as shown in FIG. 1. Pervious pavers 26 may be configured to receive storm water and/or other fluids having debris on the feed side and to retain at least a portion of the debris on feed side 28. The filtered storm water and/or fluids may be formed from the storm water and/or fluids that pass from feed side 28 to permeate side 30.

"Pervious pavers," as used herein, refers to pavers that include voids among the aggregate materials. For example, the pervious pavers may include a void space between about 10 percent to about 40 percent, preferably between about 35 percent to about 40 percent. The void space provides tortuous paths for storm water and/or other fluids to flow through but prevents pests, such as mosquitoes, from moving through the pervious pavers. In contrast, permeable pavers are pavers that include solid mass of materials (such as concrete) that are installed with gaps between portions of the pavers to make those pavers permeable. In other words, pervious pavers inherently include voids among its materials, while permeable pavers must be gapped to provide the voids.

The pervious pavers may include any suitable materials that have similar gradation and/or that are adhered to each other via glue and/or other suitable adhesive(s). For example, pervious pavers 26 may include rock aggregate, rubber, metal, glass, marble, steel ball bearings, and/or ceramic spheres. Suitable aggregate grades may, for example, include 10-12 millimeters, 14 millimeters, 16-20 millimeters, and other aggregate grades. Voids between the glued materials may allow water, fluids, and smaller particles to pass through but may prevent larger particles from passing through. For example, the pervious pavers may be configured to allow particles of less than about 0.5 millimeters to pass through but to prevent particles about 0.5 millimeters or larger to be retained on the feed side. The filtration may occur along any suitable portions of the pervious pavers, such as the feed side (or top horizontal surface) of the pervious pavers. The materials for the pervious pavers may include any suitable sizes, such as a cross-section thickness of about 1 millimeter to about 35 millimeters.

Pervious pavers 26 may have any suitable flow through rates, such as about 26 gallons per minute per square foot to about 100 gallons per minute per square foot. Additionally, the pervious pavers may have any suitable compressive strength, such as about 500 pounds per square inch to about 3000 pounds per square inch. An example of a suitable pervious paver is the XERIPAVE® paver from Xeripave, LLC in Vancouver, Wash.

The pervious pavers may have any suitable size(s). For example, each of the pervious pavers 26 may vary from about 4 inches to about 24 inches in length, about 4 inches to about 24 inches in width, and/or about 0.25 inches to about 4 inches in thickness. An example of a suitable size for pervious paver 26 is about 12 inches by about 12 inches by about 2 inches. Although filter assembly 22 is shown to include pervious pavers 26 with lengths and widths that are about equal, one or more of the pervious pavers may include lengths longer than its widths, or vice-versa.

Figure 6:
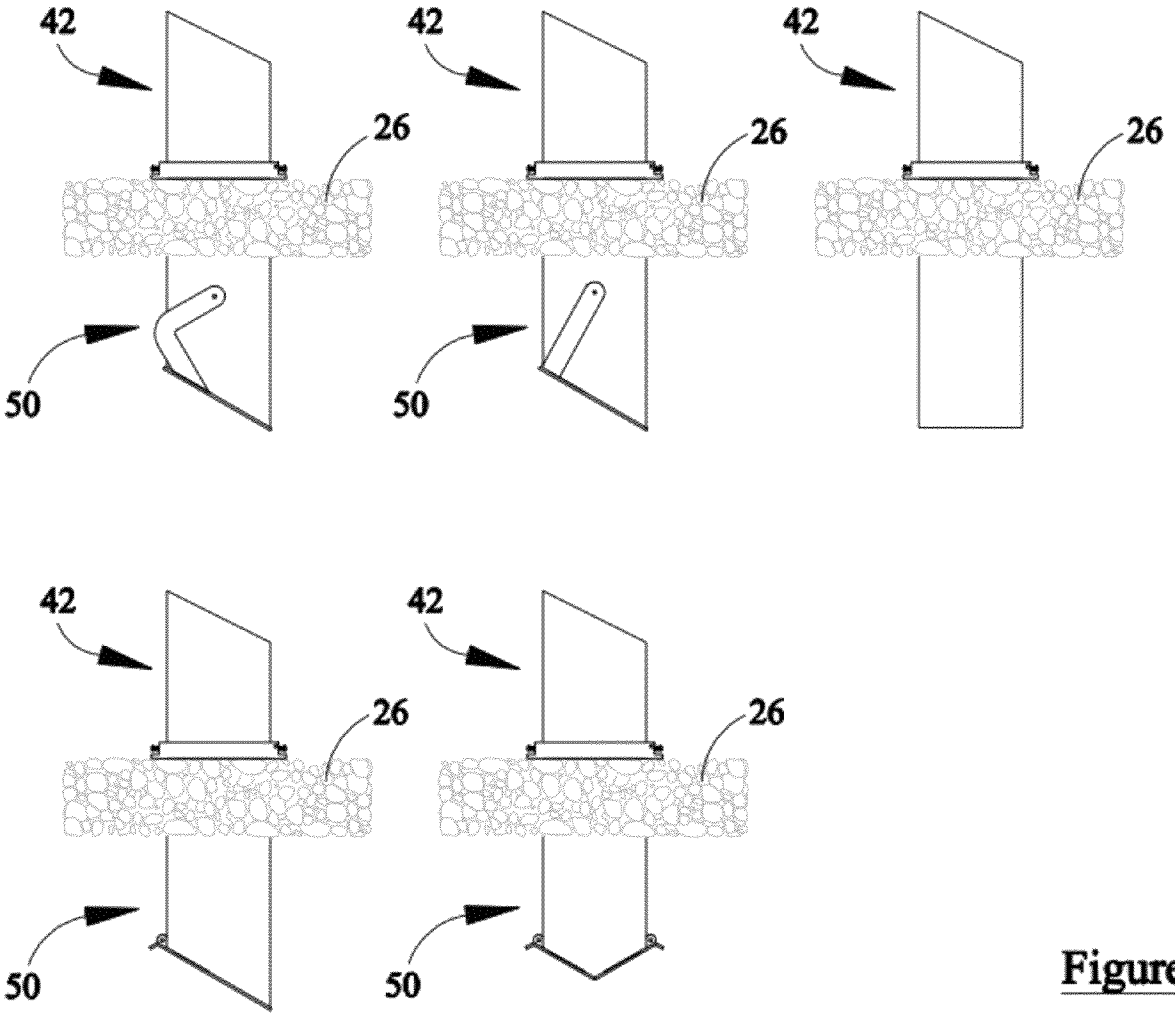
FIG. 6 are partial sectional views of the storm water filter system of FIG. 1 taken along lines 5-5 in FIG. 2, showing alternative examples of an overflow assembly.

Filter assembly 22 may include any suitable number of pervious pavers 26. For example, the filter assembly may include six pervious pavers 26, as shown in FIG. 6. Although FIG. 6 shows six pervious pavers, the filter assembly may include any suitable number of pavers, such as one, two, three, four, five, seven, eight, nine, ten, or more. Pervious pavers may be mounted to, or supported on, the frame assembly with no gap between the pavers and/or between the pavers and side walls of the storm water drain. The pervious pavers may collectively have any suitable shape(s) and/or size(s). For example, when the inlet of the storm drain has a rectangular or square cross-section having an inlet length and an inlet width, the pervious pavers may collectively have a rectangular or square cross-section with a paver length of about the inlet length and a paver width of about the inlet width. Alternatively, when the inlet of the storm drain has a circular cross-section having an inlet diameter, the pervious pavers may have a circular cross-section and collectively have a paver diameter of about the inlet diameter.

Figure 3:
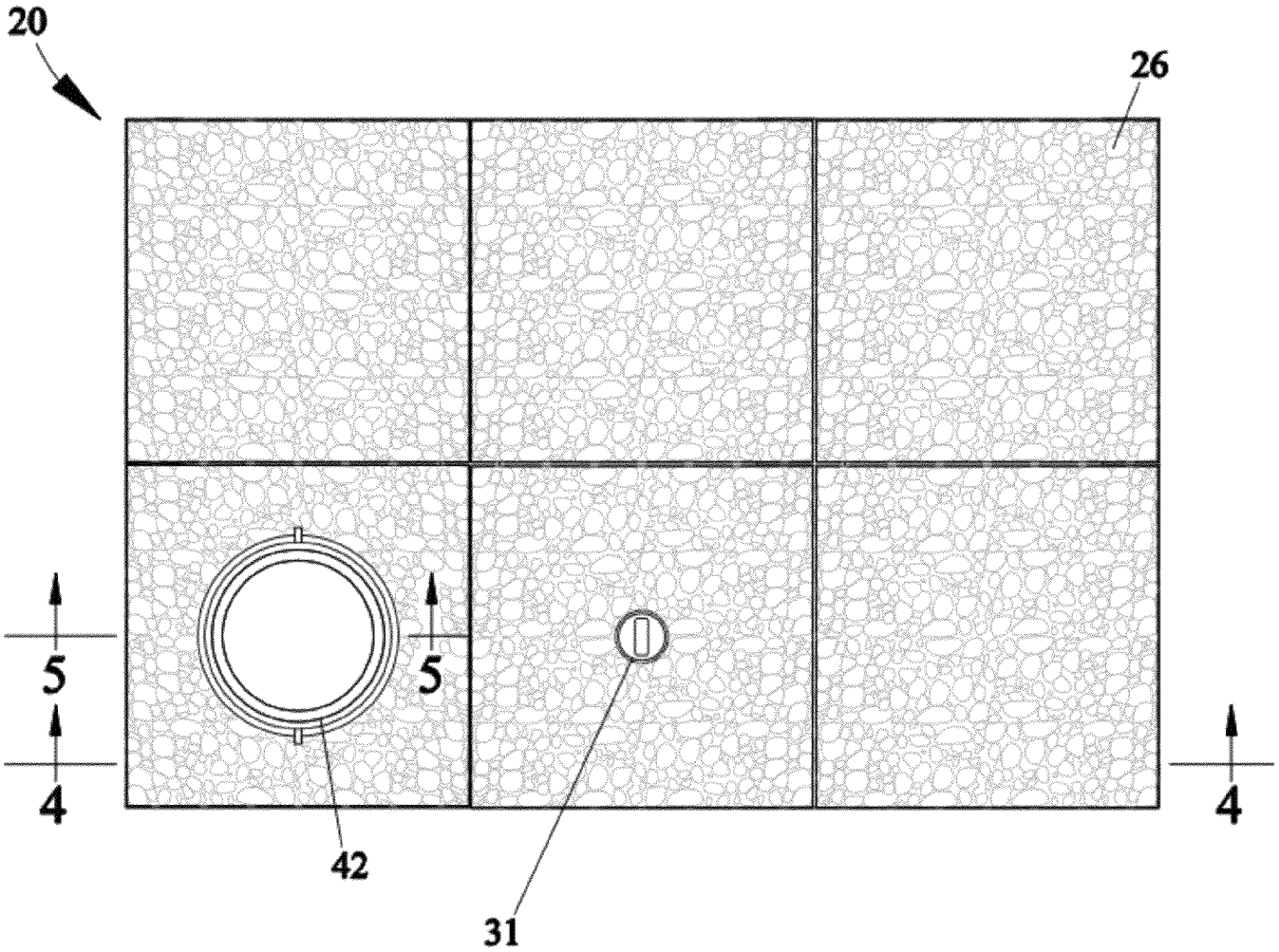
FIG. 3 is top view of the storm water filter system of FIG. 1.
Figure 7:
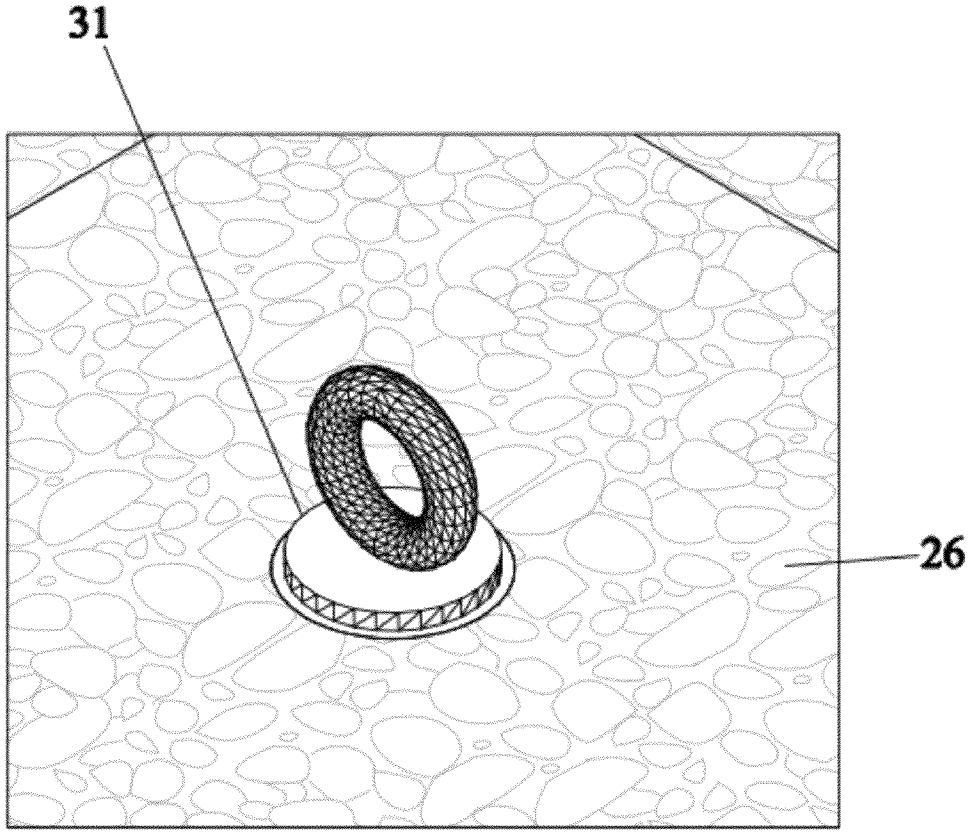
FIG. 7 is a partial view of the storm water filter system of FIG. 1, showing an example of a lifting fastener.

In some examples, filter assembly 22 may include one or more lifting fasteners (or bolts) 31, as shown in FIGS. 1, 3, and 7. The lifting fasteners may be attached to one or more of the pervious pavers and be configured to allow a user to detach the pervious paver(s) from the frame assembly, such as when the frame assembly is attached to the side wall(s) of the storm drain. Lifting fastener 31 may include the bolt shown in FIGS. 1, 3, and 7. Alternatively, or additionally, the lifting fastener may include a u-bolt, a j-bolt, and other suitable bolts. The lifting fastener may be attached to pervious paver(s) 26 via a threaded insert, adhesive(s), and/or other suitable fastener(s). Although filter assembly 22 is shown to include a single lifting fastener, the filter assembly may include two, three, four, or more lifting fasteners.

Filter assembly 22 may alternatively, or additionally, include one or more other pervious materials, such as pervious concrete and/or pervious asphalt. Alternatively, or additionally, the filter assembly may include one or more layers of screen and/or mesh.

Figure 2:
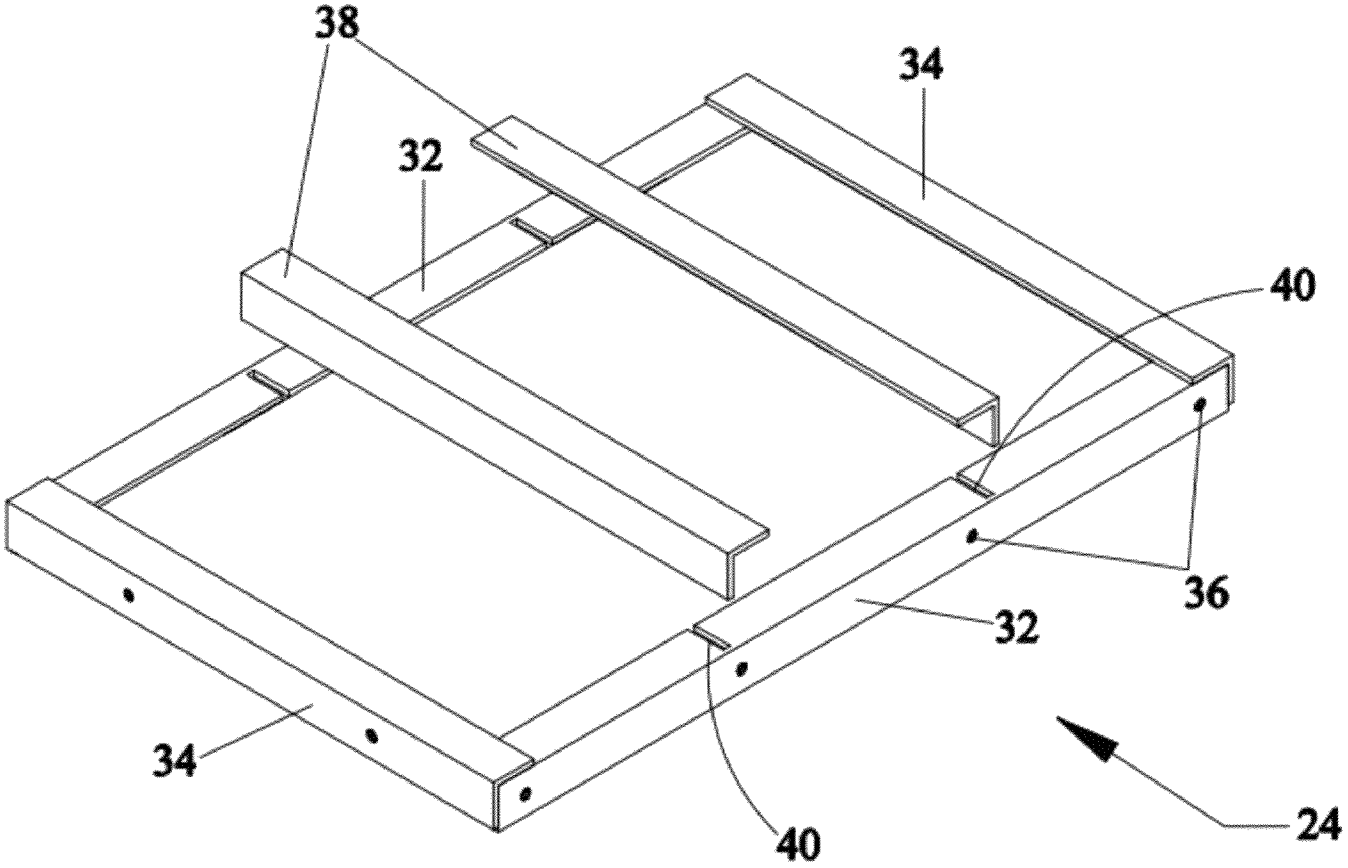
FIG. 2 is an isometric view of an example of a frame assembly for the storm water filter system of FIG. 1, shown with two optional center members detached.

Frame assembly 24 may include any suitable structure configured to support filter assembly 22, such as adjacent one or more inlets of a storm drain. For example, the frame assembly may include side members 32 and end members 34, as shown in FIG. 2. The side and end members may be attached to each other via any suitable means, such as via welding and/or one or more fasteners. The side and/or end members may include one or more holes 36 sized to receive one or more mechanical anchors 37 (shown in FIG. 1) for attaching of frame assembly to one or more side walls of a storm drain. Anchors 37 may include wedge anchors, expansion anchors, hammer-driven anchors, masonry anchors, self-threading anchors, sleeve anchors, and/or other suitable anchors.

The frame assembly may, in some examples, include one or more center members 38 configured to be received in one or more slots 40 and/or other suitable structure of side members 32, as shown in FIG. 2. The pervious paver(s) may be supported on the frame assembly. Alternatively, or additionally, the pervious paver(s) may be attached and/or mounted to the frame assembly via one or more suitable fasteners. Although frame assembly 24 is shown to include two center members, the frame assembly may include more, less, or no center members. Additionally, although frame assembly 24 is shown to include center members received in slots 40 of side members 32, the center members may alternatively be received in slots of end members 34 and/or in other suitable structure of the end and/or side members. Frame assembly 24 may sometimes be referred to as a "support framework."

Figure 4:
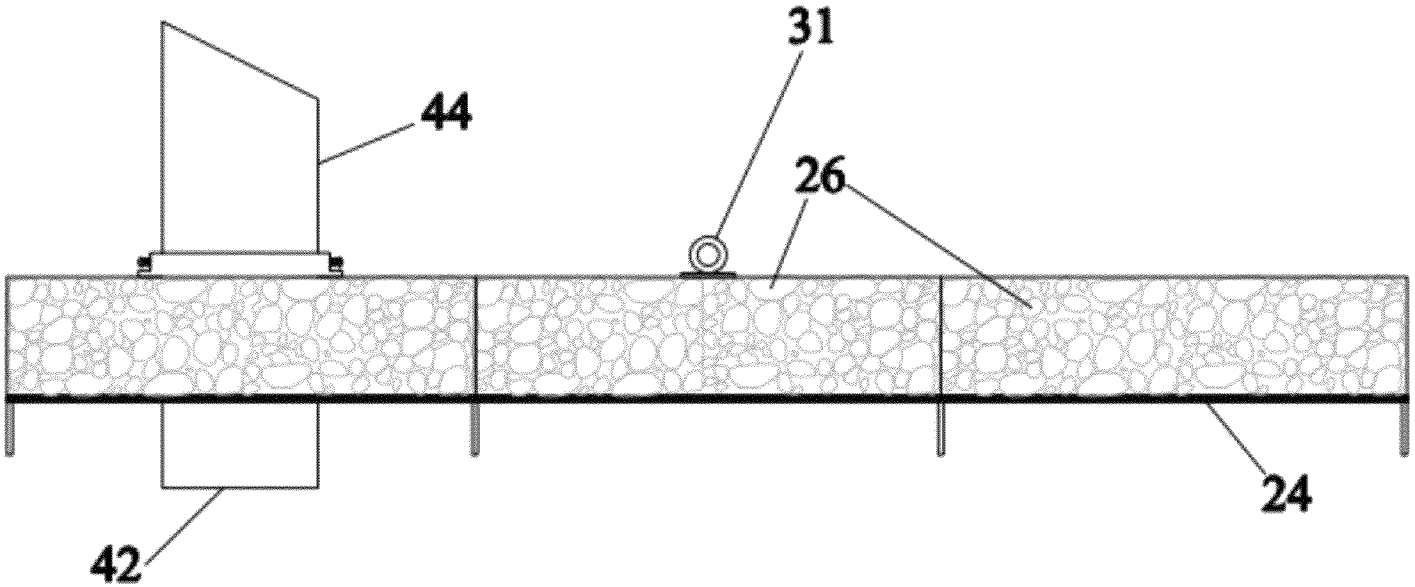
FIG. 4 is a sectional view of the storm water filter system of FIG. 1 taken along lines 4-4 in FIG. 2.
Figure 5:
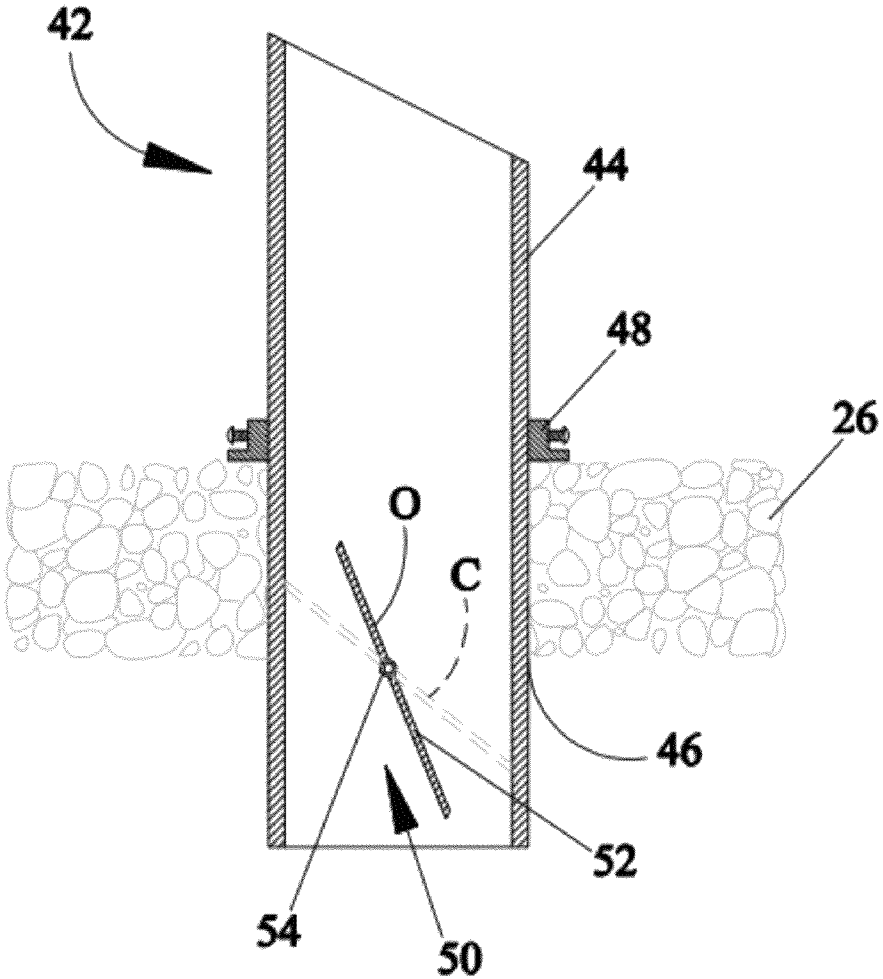
FIG. 5 is a partial sectional view of the storm water filter system of FIG. 1 taken along lines 5-5 in FIG. 2, showing an example of an overflow assembly.

In some examples, storm water filter system 20 may include an overflow assembly 42, as shown in FIGS. 3-5. The overflow assembly may include any suitable structure configured to direct an excess portion of the storm water around pervious paver 26 such that the excess portion is not filtered by pervious paver 26. Overflow assembly 42 may allow storm water to bypass the pervious paver(s) when the level of storm water on the feed side of the pervious paver exceeds a predetermined height because the storm water is not being filtered at a sufficient rate by the pervious pavers. In some examples, overflow assembly 42 may additionally, or alternatively, be configured to equalize air pressure between the feed side and the permeate side of the pervious pavers.

For example, overflow assembly 42 may include at least one overflow pipe 44 that extends through at least one aperture 46 of the pervious paver(s), as shown in FIG. 5. The overflow pipe may be any suitable size(s), such as a diameter of about 4 inches to about 10 inches and/or a length of about 1 foot to about 5 foot. Additionally, the overflow pipe may include a circular, elliptical, square, rectangular, and/or other suitable shaped cross-section. The overflow assembly may include any suitable number of overflow pipes, such as one, two, three, four or more.

In some examples, overflow assembly 42 may include a pipe support 48, which may include any suitable structure configured to retain the overflow pipe in the aperture. For example, pipe support 48 may be attached to overflow pipe 44 via any suitable fastener(s) and/or may be supported on the pervious paver, as shown in FIG. 5. The pipe support may additionally be attached to the pervious paver.

Overflow assembly 42 may, in some examples, include a valve assembly 50, as shown in FIG. 5. The valve assembly may include any suitable structure configured to regulate flow of storm water and/or other fluid(s) through overflow pipe 44. For example, valve assembly 50 may include at least one valve 52 configured to move among a plurality of positions, such as an open position O in which storm water and/or other fluid(s) are allowed to flow through the overflow pipe, and a closed position C in which the storm water and/or other fluid(s) are prevented from flowing through the overflow pipe, as shown in FIG. 5. The valve may be a flapper valve, a ball valve, and/or other suitable valves. In some examples, valve 52 may be a one-way valve (such as a check valve) that may allow storm water to flow one way through it, but prevent flow the other way.

In some examples, the valve assembly may include a biasing mechanism 54, as shown in FIG. 5. The biasing mechanism may include any suitable structure configured to urge valve 52 toward the closed position, such as one or more springs. Valve 52 may be configured to move, when overflow pipe 44 receives storm water and/or other fluids, toward the open position against urging of the biasing mechanism. Biasing mechanism 54 may, however, be configured to maintain the valve in the closed position when one or more pests attempt to move through the overflow pipe in either direction.

FIG. 6 shows various examples of overflow assembly 42. The overflow assembly may exclude valve assembly 50 or may have the valve assembly. When overflow assembly 42 includes a valve assembly 50, the valve assembly may have different valves 52 and/or biasing mechanisms 54. Although valve assembly 50 is shown with particular valves and/or biasing mechanisms in FIG. 6, the valve assembly may alternatively, or additionally, include any suitable valve(s) and/or biasing mechanism(s).

Figure 8:
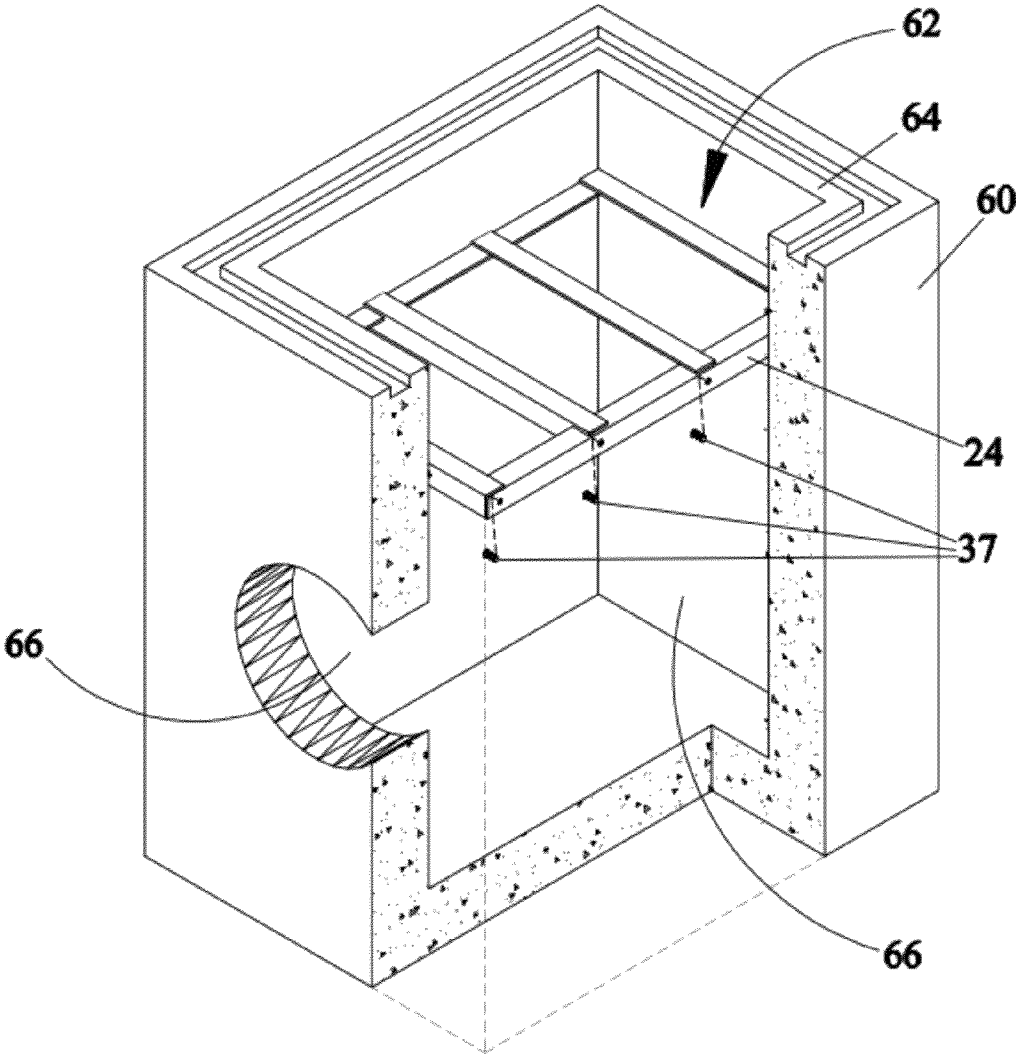
FIG. 8 is an isometric view of a sump basin, shown without a portion of the sump basin to illustrate mounting of the frame assembly of FIG. 2.
Figure 9:
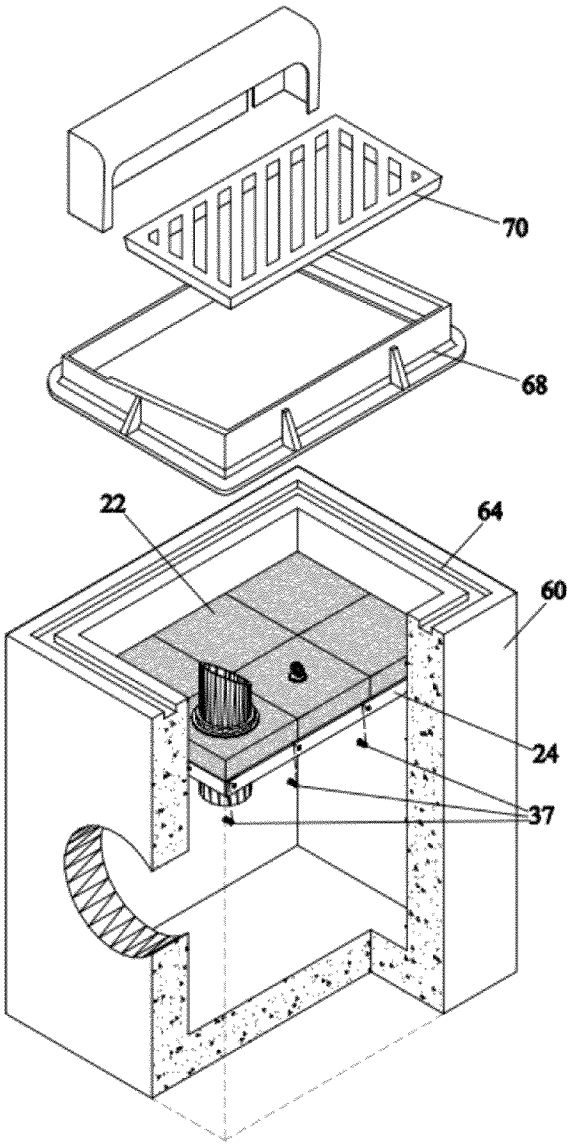
FIG. 9 is an isometric view of the sump basin of FIG. 8, showing the frame assembly of FIG. 2 supporting a filter assembly and an overflow assembly, and showing grating components detached from the sump basin.

Storm water filter system 20 may be installed in any suitable structures, such as a storm water drain 60. The storm water drain may include an inlet 62, a ledge 64 at least partially surrounding the inlet, side walls 66, a frame 68 supported on the ledge, and a grate 70, as shown in FIGS. 8-9. Frame assembly 24 may be mounted to one or more of the side walls via anchors 37 in any suitable location(s), such as adjacent to, but spaced from, the inlet, as shown in FIG. 8. In some examples, the frame assembly may be configured to be attached to the side wall(s) without the frame assembly contacting the ledge. Pervious paver(s) 26 may be positioned on the frame assembly, as shown in FIG. 9.

Figure 10:
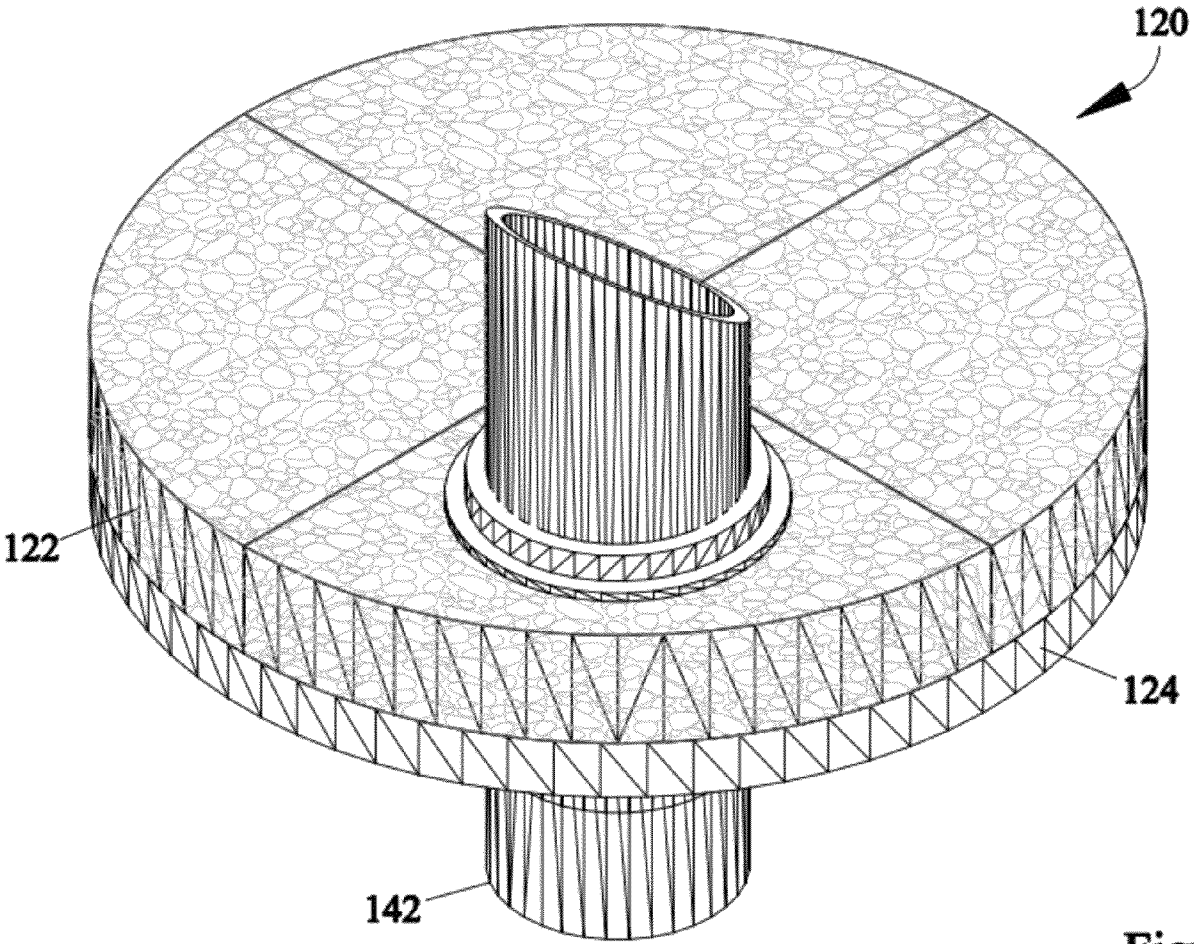
FIG. 10 is an isometric view of another example of a storm water filter system.

Another example of a storm water filter system 20 is shown in FIG. 10 and is generally indicated at 120. Unless explicitly stated, storm water filter system 120 may include one or more components and/or functions of the above storm water filter system. Storm water filter system 120 may include a filter assembly 122, a frame assembly 124, and an overflow assembly 142.

One or more of the above storm water filter systems may be used as part of a method of filtering storm water and/or other fluid(s) received in a storm drain. For example, the method may include directing storm water and/or other fluids on to the feed side of the pervious paver(s) of the storm water filter system. The method may additionally include filtering the storm water and/or other fluid(s) via the pervious paver(s) such that at least a portion of the debris is retained on the feed side of the pervious paver(s). The method may further include directing an excess portion of the storm water and/or other fluids around the pervious paver(s) such that the excess portion is not filtered by the pervious paver(s).

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein.

Applicant reserves the right to submit claims directed to certain combinations and subcombinations that are directed to one of the disclosed inventions and are believed to be novel and non-obvious. Inventions embodied in other combinations and subcombinations of features, functions, elements and/or properties may be claimed through amendment of those claims or presentation of new claims in that or a related application. Such amended or new claims, whether they are directed to a different invention or directed to the same invention, whether different, broader, narrower or equal in scope to the original claims, are also regarded as included within the subject matter of the inventions of the present disclosure. Where such claims recite "a" or "a first" element or the equivalent thereof, such claims should be understood to include incorporation of one or more such elements, neither requiring nor excluding two or more such elements.

What is claimed is:

1. A filter system for a storm drain, the storm drain having a plurality of side walls defining an inlet and a grate covering the inlet, the filter system configured to receive stormwater having debris and to separate at least a portion of the debris from the stormwater to produce filtered stormwater, comprising:

a pervious paver having a feed side and a permeate side, the pervious paver being configured to receive stormwater on the feed side and to retain at least a portion of the debris on the feed side, the filtered stormwater being formed from the stormwater that passes from the feed side to the permeate side, the pervious paver including an aperture;

a frame assembly configured to support the pervious paver adjacent to the inlet such that a recess is formed between the grate and the pervious paver, the recess being configured to contain the at least a portion of the debris to allow for removal of the at least a portion of the debris from the pervious paver when the grate does not cover the inlet; and an overflow assembly including a vertically-oriented overflow pipe that extends through the aperture, the overflow pipe being free from any bends and having a single inlet opening on a first end portion of the overflow pipe and a single outlet opening on an opposing second end portion of the overflow pipe, the overflow assembly further including a valve assembly having:

a valve configured to move between an open position in which the stormwater is allowed to flow through the overflow pipe, and a closed position in which the stormwater is prevented from flowing through the overflow pipe, and a biasing mechanism configured to urge the valve toward the closed position, the valve being configured to move, when the overflow pipe receives the stormwater, toward the open position against urging of the biasing mechanism, the biasing mechanism further configured to maintain the valve in the closed position when a pest attempts to move through the overflow pipe.

2. The filter system of claim 1, wherein the overflow assembly includes a pipe support attached to the overflow pipe and supported on the pervious paver.

3. The filter system of claim 1, where the inlet has a rectangular or square cross-section having an inlet length and an inlet width, wherein the pervious paver has a paver length of about the inlet length, and a paver width of about the inlet width.

4. The filter system of claim 1, where the inlet has a circular cross-section having an inlet diameter, wherein the pervious paver has a paver diameter of about the inlet diameter.

5. The filter system of claim 1, wherein the pervious paver is configured to have a flow through rate of about 26 gallons per minute per square foot to about 100 gallons per minute per square foot.

6. The filter system of claim 1, wherein the pervious paver is configured to have a compressive strength of about 500 pounds per square inch to about 3000 pounds per square inch.

7. The filter system of claim 1, wherein the valve assembly further includes a pivot arm pivotably attached to the overflow pipe and configured to move the valve between the open and closed positions, the pivot arm being external to the overflow pipe.

8. The filter system of claim 7, wherein the biasing mechanism is configured to urge the pivot arm to move the valve toward the closed position, the pivot arm being configured to move the valve, when the overflow pipe receives the stormwater, toward the open position against urging of the biasing mechanism.

9. The filter system of claim 8, wherein the biasing mechanism is configured to urge the pivot arm such that the valve is maintained in the closed position when a pest attempts to move through the overflow pipe.

10. The filter system of claim 1, wherein at least one of the inlet opening and the outlet opening is an oblique opening.

* * * * *